US007631647B2

(12) United States Patent
Sonstegard

(10) Patent No.: US 7,631,647 B2
(45) Date of Patent: Dec. 15, 2009

(54) WOMAN'S HAIR BUN HOLDER

(75) Inventor: Lois J. Sonstegard, Orono, MN (US)

(73) Assignee: LJL, Inc., Minneapolis, MN (US)

( * ) Notice: Subject to any disclaimer, the term of this patent is extended or adjusted under 35 U.S.C. 154(b) by 481 days.

(21) Appl. No.: 11/711,494

(22) Filed: Feb. 27, 2007

(65) Prior Publication Data

US 2007/0221243 A1 Sep. 27, 2007

Related U.S. Application Data

(60) Provisional application No. 60/777,453, filed on Feb. 27, 2006.

(51) Int. Cl.
*A45D 8/00* (2006.01)
*A45D 8/12* (2006.01)

(52) U.S. Cl. ..... 132/273; 132/275

(58) Field of Classification Search ..... 132/273, 132/275, 251, 252; 63/20; 24/351, 352
See application file for complete search history.

(56) References Cited

U.S. PATENT DOCUMENTS 712,657 A * 11/1902 Davis ..... 132/106
1,867,169 A 7/1932 Peck
2,256,143 A * 9/1941 Dunlavy ..... 132/251
2,668,547 A 2/1954 Wille
2,796,069 A * 6/1957 Mooney, Jr. ..... 132/273
2,847,016 A 8/1958 Rabinowitz
3,343,549 A * 9/1967 Weitzner ..... 132/251
4,182,073 A * 1/1980 Tabet ..... 446/46
5,100,356 A * 3/1992 Atwell ..... 446/48
5,156,023 A * 10/1992 Bevolo ..... 63/20
5,857,468 A * 1/1999 Camp et al. ..... 132/273
6,289,903 B1 9/2001 Haufler
D449,409 S * 10/2001 Chavis ..... D28/39

* cited by examiner

*Primary Examiner*—Robyn Doan
(74) *Attorney, Agent, or Firm*—Kinney & Lange, P.A.

(57) ABSTRACT

First and second holders for styling a person's hair in a selected form with respect to at least a portion thereof which holders can be used individually or in combination. In combination, protuberances in one holder can be forced into openings in the other to thereby be held together as a unit. There are provisions to aid fastening these holders in a person's hair and to hold decorative items therein.

4 Claims, 4 Drawing Sheets

WOMAN'S HAIR BUN HOLDER

CROSS-REFERENCE TO RELATED APPLICATION(S)

This application claims the benefit of Provisional Application No. 60/777,453 filed on Feb. 27, 2006 for "WOMAN'S HAIR BUN HOLDER".

BACKGROUND OF THE INVENTION

Women have many alternative hair styles they use to present themselves in public. Among these is the use of a hair bun formed at the back of a woman's head. There is a desire to have such buns enhanced with decorative holders that can be used in forming and maintaining such hair buns.

BRIEF SUMMARY OF THE INVENTION

The present invention provides first and second holders for styling a person's hair in a selected form with respect to at least a portion thereof which holders can be used individually or in combination. The first holder comprises a portion of a first substantially circular disk formed of a flexible material arrayed about a first circular arc center opening with said first circular disk portion having a circumference at radii larger than that of said first circular arc center opening exceeding half a circle thereabout to extend radially outward from said first circular arc center opening with two major surfaces on either side thereofending in an undulating outer edge. There is a plurality of openings in this first holder each of a selected shape extending between said major surfaces of said first circular disk portion each along a corresponding radial direction in said first circular disk. The second holder comprises a portion of a second substantially circular disk formed of a flexible material arrayed about a second circular arc center opening with said second circular disk portion having a circumference at radii larger than that of the second circular arc center opening exceeding half a circle thereabout to extend radially outward from said second circular arc center opening with two major surfaces on either side thereof ending in an undulating outer edge. There is a plurality of protuberances extending outward from one of said major surfaces of said second circular disk portion each having a peripheral closed surface thereabout extending outward from that said major surface at least one of which protuberances has said peripheral closed surface thereof matching said selected shape of a corresponding one of said plurality of openings such that they are positionable therein. There are provisions to aid fastening these holders in a person's hair and to hold decorative items therein.

DETAILED DESCRIPTION

Figure 1A:
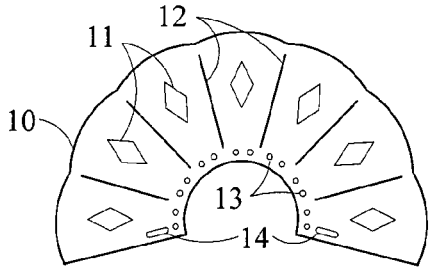
FIGS. 1A and 1B show a top view and a side view of one of two structures embodying the present invention.
Figure 1B:
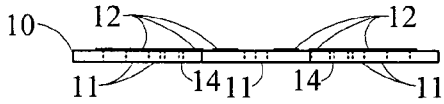

FIG. 1A shows a top view and FIG. 1B shows a side view of a decorative holder, 10, for hair buns that can be used by itself as a holder, or as a structural portion of a combination of forming a further decorative hair bun forming and holding device using the holder shown in FIGS. 1E and 1F as will be described below. Holder 10 of FIGS. 1A and 1B is formed, generally, as a portion of a circular disk generally extending along a circular arc of approximately 210° extent, and having a wavy or scalloped form undulating outer edge also, on the average, following an outer circular arc. This disk has a circular arc as the interior edge thereof, and this interior edge and the outer edge of the disk are joined by two angled straight lines at the opposite ends thereof to form the disk side edges.

The interior of this disk portion structure has therein rhombic shaped openings, 11, also distributed along the circular arc in the disk as seen in FIG. 1A with the edges of these openings shown in dashed line form in FIG. 1B to the extent they do not have another thereof between them and the edge seen in that figure. These openings have the more widely separated opposite vertices thereof at a disk surface each being along a corresponding radial direction in that circular disk. Openings 111 are separated from one another by stiffening raised line ridges, or ribs, 12, therebetween each lying on a radius of the disk and positioned approximately 30° from the others of these ribs nearest thereto as seen in FIG. 1A. Foreshortened versions of ribs 12 are seen as lines in FIG. 1B.

Small circular openings, 13, are provided in the disk portion just outside the circular arc inner edge of holder 10 again distributed along a circular ark in the disk as is seen in FIG. 1A, and through which other decorative additions to holder 10 can be affixed. Openings 13 are not shown in FIG. 1B to avoid obscuring those features which are shown there. Holder 10, itself, is affixed to the wearer's hair by hairpins passed through a pair of radially aligned slot openings, 14, each pair member just outside of openings 13 near a corresponding side edge of the disk.

The material of decorative holder 10 can be of the material Santoprene®, a thermoplastic elastomer manufactured by Monsanto Corporation of St. Louis, Mo. This material can be provided in a range of colors by providing dyes or pigments therein and can be further supplemented by distributing speckles therein, or both. The resiliency of this material allows rhombic openings 11 to be spread apart to increase the area thereof so as to permit accommodating therein rhomboids which are provided in the holder of FIG. 1B as a basis for holding the structural portions of FIGS. 1A and 1B together.

Figure 1C:
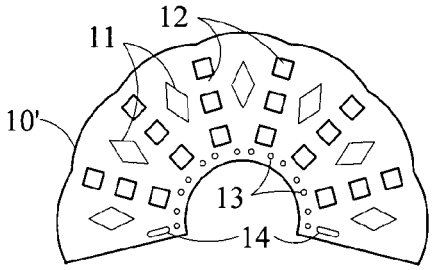
FIGS. 1C and 1D show a top view and a side view of one of two structures embodying the present invention alternative to the structure of FIGS. 1A and 1B, FIGS. 1E and 1F show a top view and a side view of the remaining one of two structures embodying the present invention.
Figure 1D:
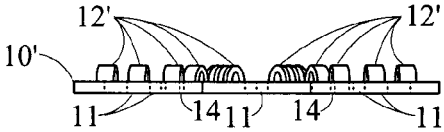

An alternative holder, 10', is shown in a top view in FIG. 1C and the corresponding side view of FIG. 1D. Here, three spatially separated truncated semicircular cylindrical shells, 12', each about an interior open passageway space are positioned aligned with one another along each of the positions of ribs 12 in holder 10 but with such ribs not present in holder 10'. These shells serve as decoration holders such as for holding stems of flowers.

Figure 1E:
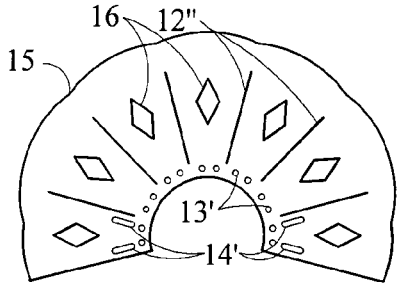
Figure 1F:
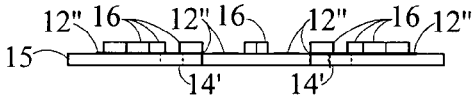

Turning to FIG. 1E, there is shown a top view, and a side view in corresponding FIG. 1F, of a further decorative hair bun holder, 15, that can again be used by itself as a holder, or as a structural portion of a combination with holders 10 or 10' as indicated above. Holder 15 may be formed of the same material as holder 10, or not, but not necessarily of the same color or with the same kind of speckles being distributed therein, i.e. variations between the two can be chosen to enhance the decorative effect of the combination thereof. Holder 15 is again formed as part of a circular disk portion with a scalloped or wavy form undulating outer edge and a circular arc inner edge which are joined by angled straight line edges. Again, the disk portion generally extends for approximately 210° of a circular arc. Here, too, are provided stiffening raised line ridges, or ribs, 12", each along a corresponding disk radius similar to ribs 12 in holder 10, additional decorative device fastening holes 13' just outside the central opening circular arc interior edge of the disk, and two pairs of radially aligned hairpin slots 14' just outside of openings 13' with each member of one pair near a corresponding side edge of the disk with an adjacent member of the other pair a relatively small distance further inward in the disk at the same radius for corresponding portions of each. The second pair of slots 14' has been added here because of the larger size of holder 15 with respect to holder 10 which may require additional hairpins to keep the holder in the wearer's hair during use.

Adjacent ones of stiffening ribs 12" in holder 15 have between them a corresponding one of a plurality of protuberant rhombohedrons, 16, each extending out from the main disk surface of holder 15 viewed in FIG. 1E sufficiently so that they can be forced into similarly shaped rhombic openings 11 of holder 10. As such, rhombohedrons 16 are distributed along the circular arc in the disk of holder 15 at radius allowing them to be matched to rhombic openings 11 of holder 10 in having the more widely separated opposite vertices thereof at the disk surface being along a corresponding radial direction in that circular disk. The forcing of rhombohedrons 16 into rhombic openings 11 of holder 10 thereby maintains these two holders together as a separable unit. That is, rhombic openings 11 are such that they form a slight interference fit with rhombohedrons 16 when projected therethrough to be positioned therein. Thus, holders 10 and 15 can be snapped together as a structural hair bun holding unit through the insertion of rhombohedrons 16, raised from the main front surface of holder 15, into rhombic openings 11 of holder 10.

Figure 2A:
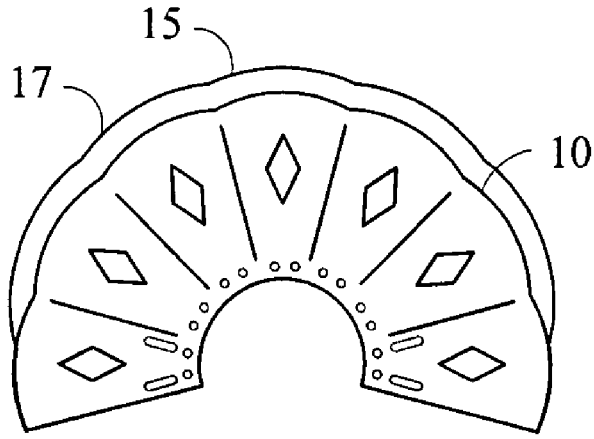
FIGS. 2A and 2B shows one combination using together the structures of FIGS. 1A, 1B, 1E and 1F.
Figure 2B:
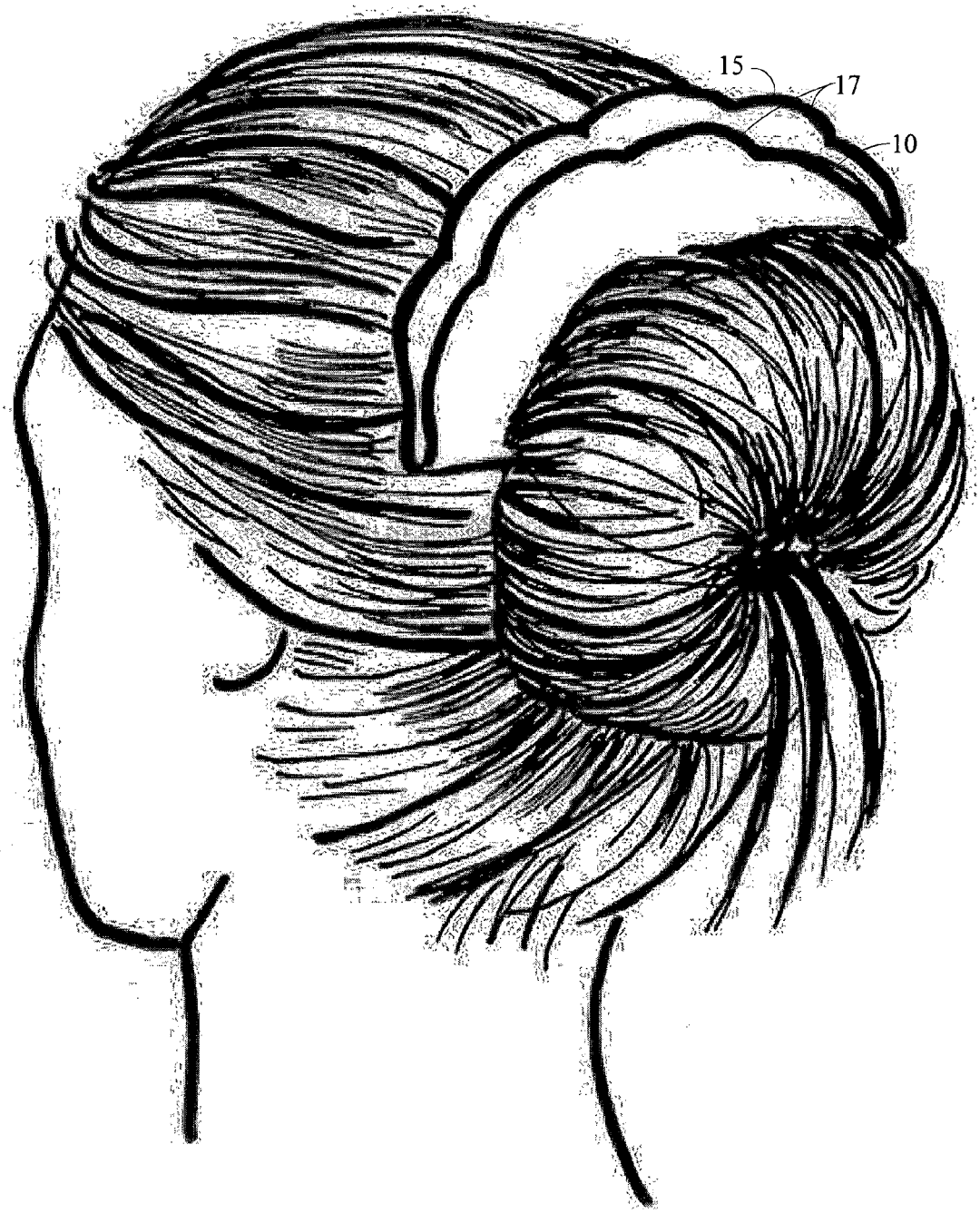

Two such combinations are shown in FIGS. 2 and 3. A first combination, 17, shown in a front view of the combination in FIG. 2 has holder 10 covering approximately all of the surface of the combination 17 in that figure so that all the rhombohedrons 16 of holder 15 project through a corresponding different one of all of the rhombic openings 11 in holder 10. Together as shown in FIG. 2A, holders 10 and 15 give something of a stacked hand fans appearance as can be further seen in the pictorial view in FIG. 2B with a representational showing of holders combination 17 being used by a woman to form and hold one style of a hair bun. Holder 10' can be substituted for holder 10 in combination 17.

Figure 3A:
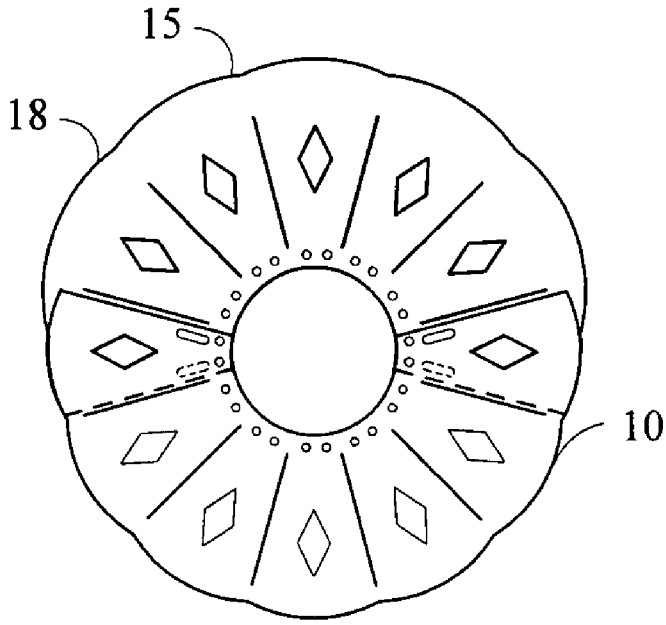
FIGS. 3A and 3B shows another combination using together the structures of FIGS. 1A, 1B, 1E and 1F.
Figure 3B:
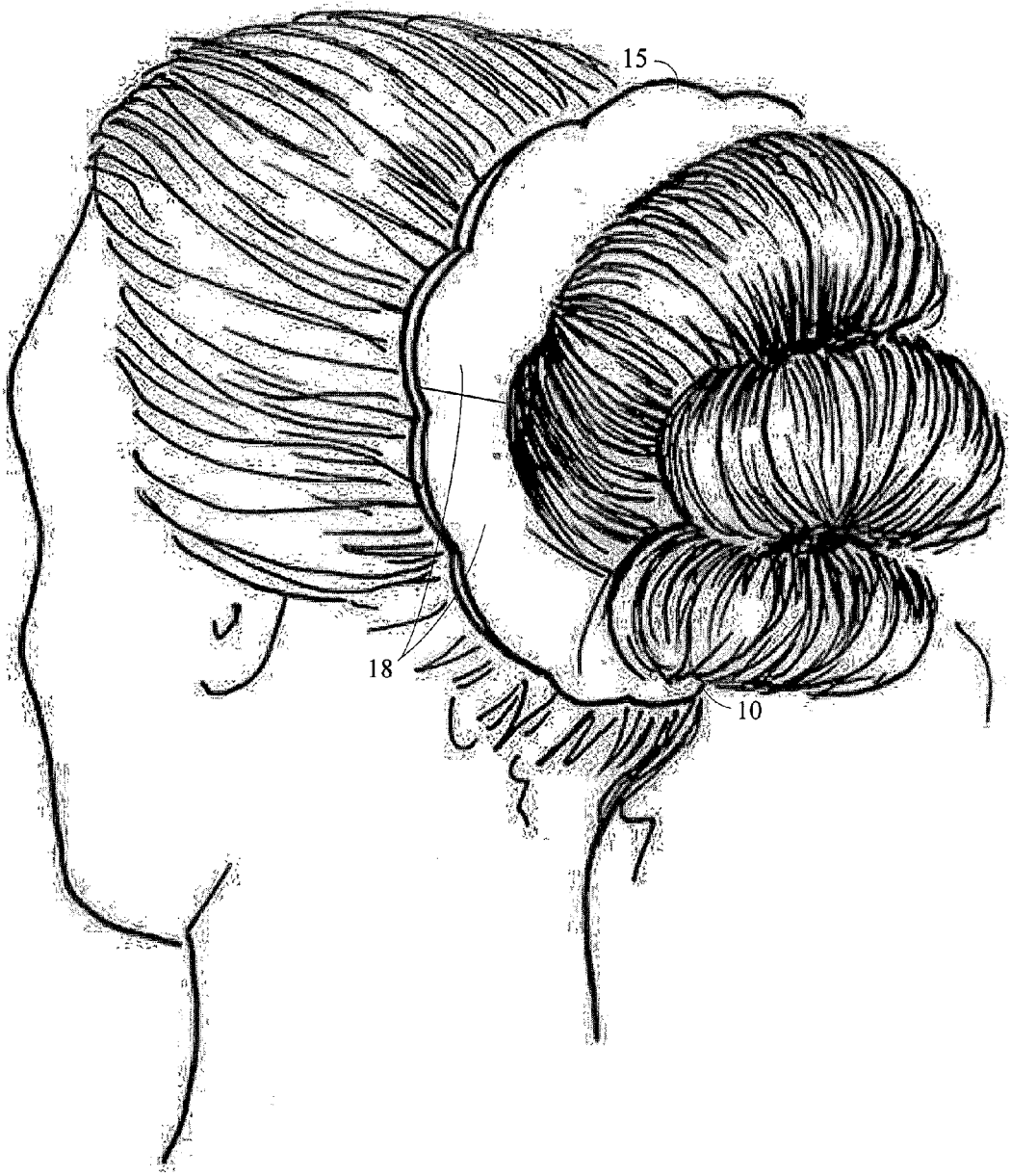

Alternatively, a further combination, 18, is shown in FIG. 3A where only those rhombohedrons 16 at the opposite ends of the holder disk 15 are inserted into two corresponding rhombic openings 11 at the opposite ends of holder disk 10. Holders 10 and 15, so assembled, together form a complete more or less circular disk together although not quite following a common circular arc. Such an arrangement provides a flower petal appearance as can be seen for this combination in the front view thereof in FIG. 3A and in the pictorial view in FIG. 3B with a representational showing of holders combination 18 being used by a woman to form and hold another style of a hair bun. Here, too, holder 10' can be substituted for holder 10 in combination 18.

Although the present invention has been described with reference to preferred embodiments, workers skilled in the art will recognize that changes may be made in form and detail without departing from the spirit and scope of the invention.

The invention claimed is:

1. A combination of holders for styling a person's hair in a selected form with respect to at least a portion thereof, said holder combination comprising:

a first holder comprising:

a portion of a first substantially circular disk formed of a flexible material arrayed about a first circular arc center opening with said first circular disk portion having a circumference at first radii larger than that of said first circular arc center opening exceeding half a circle thereabout to extend radially outward from said first circular arc center opening with two major surfaces on either side thereof ending in an undulating outer edge, a plurality of openings each of a selected shape extending between said major surfaces of said first circular disk portion substantially perpendicular to said first radii and each positioned along a corresponding radial direction in said first circular disk, said first holder further comprising a plurality of pair of at least a portions of truncated cylindrical shells at a major surface of said first circular disk portion with each said pair having its members aligned with one another along a corresponding radial direction in said first circular disk portion so as to have a passaway therethrough along that radial direction and each pair having a corresponding one of said plurality of openings therebetween, and a second holder comprising:

a portion of a second substantially circular disk formed of a flexible material arrayed about a second circular arc center opening with said second circular disk portion having a circumference at second radii larger than that of the second circular arc center opening exceeding half a circle thereabout to extend radially outward from said second circular arc center opening with two major surfaces on either side thereof ending in an undulating outer edge, and a plurality of protuberances extending outward from one of said major surfaces of said second circular disk portion substantially perpendicular to said second radii and each having a peripheral closed surface thereabout extending outward from that said major surface at least one of which protuberances has said peripheral closed surface thereof matching said selected shape of a corresponding one of said plurality of openings and is positioned therein.

2. The combination of claim 1 further comprising each of said plurality of protuberances having said peripheral closed surface thereof matching said selected shape of a corresponding one of said plurality of openings and is positioned therein.

3. The combination of claim 1 further comprising said plurality of pairs each having at least a portion of a third truncated cylindrical shell at a major surface of said first circular disk portion aligned therewith so as to have a passageway therethrough along said radial direction.

4. The combination of claim 1 further comprising at least two of said plurality of protuberances having said peripheral closed surface thereof matching said selected shape of a corresponding one of said openings and are positioned therein.

* * * * *